US005626250A

United States Patent [19]

Dorazio

[11] Patent Number: 5,626,250

[45] Date of Patent: May 6, 1997

[54] CONTAINER APPARATUS HAVING DETACHABLE AND DISCARDABLE WALL SECTIONS

[76] Inventor: Alfonse A. Dorazio, 1645 W. Montebella Pl., Tucson, Ariz. 85704

[21] Appl. No.: 674,138

[22] Filed: Jul. 1, 1996

[51] Int. Cl.[6] ..... B65D 8/04

[52] U.S. Cl. ..... 220/4.26; 426/130; 229/101.1; 229/101.2; 220/4.33

[58] Field of Search ..... 220/4.26, 4.33, 220/4.27, 678; 426/130, 111, 115; 229/101.1, 101.2

[56] References Cited

U.S. PATENT DOCUMENTS

| | | | |
|---|---|---|---|
| 2,852,179 | 9/1958 | Bieler | 426/130 |
| 3,539,093 | 11/1970 | Massengill | 426/130 |
| 4,091,929 | 5/1978 | Krane | 426/130 |
| 4,724,756 | 2/1988 | Sarparanta | 220/4.26 |
| 5,215,222 | 6/1993 | McGill | 222/95 |
| 5,361,933 | 11/1994 | Oster | 220/578 |

FOREIGN PATENT DOCUMENTS

| | | | |
|---|---|---|---|
| 907953 | 3/1946 | France | 220/4.27 |
| 18819 | 5/1915 | United Kingdom | 229/101.2 |

*Primary Examiner*—Stephen J. Castellano
*Attorney, Agent, or Firm*—LaRiviere, Grubman & Payne

[57] ABSTRACT

A container apparatus formed having a main wall section that can be selectively, and repeatedly perforated at different regions to form a plurality of detachable wall sections that can be detached and discarded to reduce the size of the container according to graduated amounts of the contents being used. The container is useable in the storage of food product and helps maintain the freshness of foods, such as ice cream, by virtue of the container structure that facilitates reduction of the internal volume of the container, and hence the amount air space above the surface of the remaining food product in the opened container. The container structure includes a body having a bottommost container portion connecting to the main wall section from which the plurality of detachable wall sections can be formed. The main wall section includes an uppermost wall section member that connects to a container lid. The plurality of detachable wall sections being delineated by a plurality of strip members that are spatially disposed on the outside of the main wall section. Each strip member includes a perforating element in contact with an underlying region of the main wall section. The perforating element being selectively utilized to cause the underlying region to be perforated and thereby form a detachable wall section. In an unutilized state, each strip member includes a pull tab portion and an end portion disposed in an overlapping configuration to form a junctional region on the outside of the main wall section. Each junctional region being covered by a tamper-proof seal.

3 Claims, 4 Drawing Sheets

CONTAINER APPARATUS HAVING DETACHABLE AND DISCARDABLE WALL SECTIONS

FIELD OF THE INVENTION

The present invention relates to containers. More particularly, the present invention relates to containers with structure that facilitates reducing the container's volume. Even more particularly, the present invention relates to containers for storing food products and which have structure that facilitates reducing the container's volume for purposes of preserving freshness of the contained product and conserving shelf space for the container.

DESCRIPTION OF THE PRIOR ART

The problem of maintaining food product in a high state of freshness throughout the storage life is related to the inadequacy of containers to compensate for the exposure of the product to the volume of air in the upper space of the container that result from continual removal of product from the container. While the problem has been recognized by others, the solutions have not been widely accepted. Notably, U.S. Pat. No. 5,361,933 teaches a shield that forms a removable cover for placement on the surface of ice cream remaining in an opened container. This solution requires inventory of shields which may or my not be compatible with the internal geometry and dimensions of a particular container purchased. Other known containers that have variable internal volume include deformable corrugated containers, substantially as depicted in FIG. 4 of U.S. Pat. No. 5,215,222. While a deformable corrugated container does have the capability of reducing the volume of the upper space of a container, and hence the overall shelving space for the container, the internal corrugated structure of a deformable corrugated container lacks the straight walled feature that is characteristic, and desirable of most container used in storing food product, such as ice cream.

As mentioned previously, the known prior art container apparatus have not been successfully in addressing the problem of keeping food product fresh in an opened container while reducing the internal volume of the container. Thus, a need is still seen to exist for a container that addresses this problem.

It is therefore a primary object of this invention to provide a container apparatus that has structure that facilitates reducing the internal volume of the container after a certain amount of content has been removed from the opened container.

SUMMARY OF THE INVENTION

Accordingly, the foregoing object is accomplished by providing a container apparatus formed having a main wall section that can be selectively, and repeatedly perforated at different regions to form a plurality of detachable wall sections that can be detached and discarded to reduce the size of the container according to graduated amounts of the contents being used. The container is useable in the storage of food product and helps maintain the freshness of foods, such as ice cream, by virtue of the container structure that facilitates reduction of the internal volume of the container, and hence the amount air space above the surface of the remaining food product in the opened container. The container structure includes a body having a bottommost container portion connecting to the main wall section from which the plurality of detachable wall sections can be formed. The main wall section includes an uppermost wall section member that connects to a container lid. The uppermost wall section member being periodically determined after a detachable wall section has been detached and discarded. The plurality of detachable wall sections are delineated by a plurality of strip members that are spatially disposed on the outside of the main wall section. Each strip member includes a perforating element in contact with an underlying region of the main wall section. The perforating element being selectively utilized to cause the underlying region to be perforated and thereby form a detachable wall section. In an un-utilized state, each strip member includes a pull tab portion and an end portion disposed in an overlapping configuration to form a junctional region on the outside of the main wall section. Each junctional region being covered by a tamper-proof seal.

The container in one embodiment is formed in the shape of a cylindrical body and includes a plurality of strip members spatially disposed on a main cylindrical wall section which can be selectively perforated by the perforating element for forming a detachable cylindrical shell which can be detached and effect formation of a smaller sized cylindrical body.

In another embodiment, the container is formed in the shape of an elongated rectangular body and includes a plurality of strip members spatially disposed on a main rectangular wall section which can be selectively perforated by the perforating element for forming a detachable rectangular shell which can be detached to effect formation of a smaller sized rectangular body.

Therefore, to the accomplishments of the foregoing object, the invention consists of the foregoing features hereinafter fully described and particularly pointed out in the claims, the accompanying drawings and the following disclosure describing in detail the invention, such drawings and disclosure illustrating but one of the various ways in which the invention may be practiced.

DESCRIPTION OF THE PREFERRED EMBODIMENT OF THE INVENTION

Figure 1:
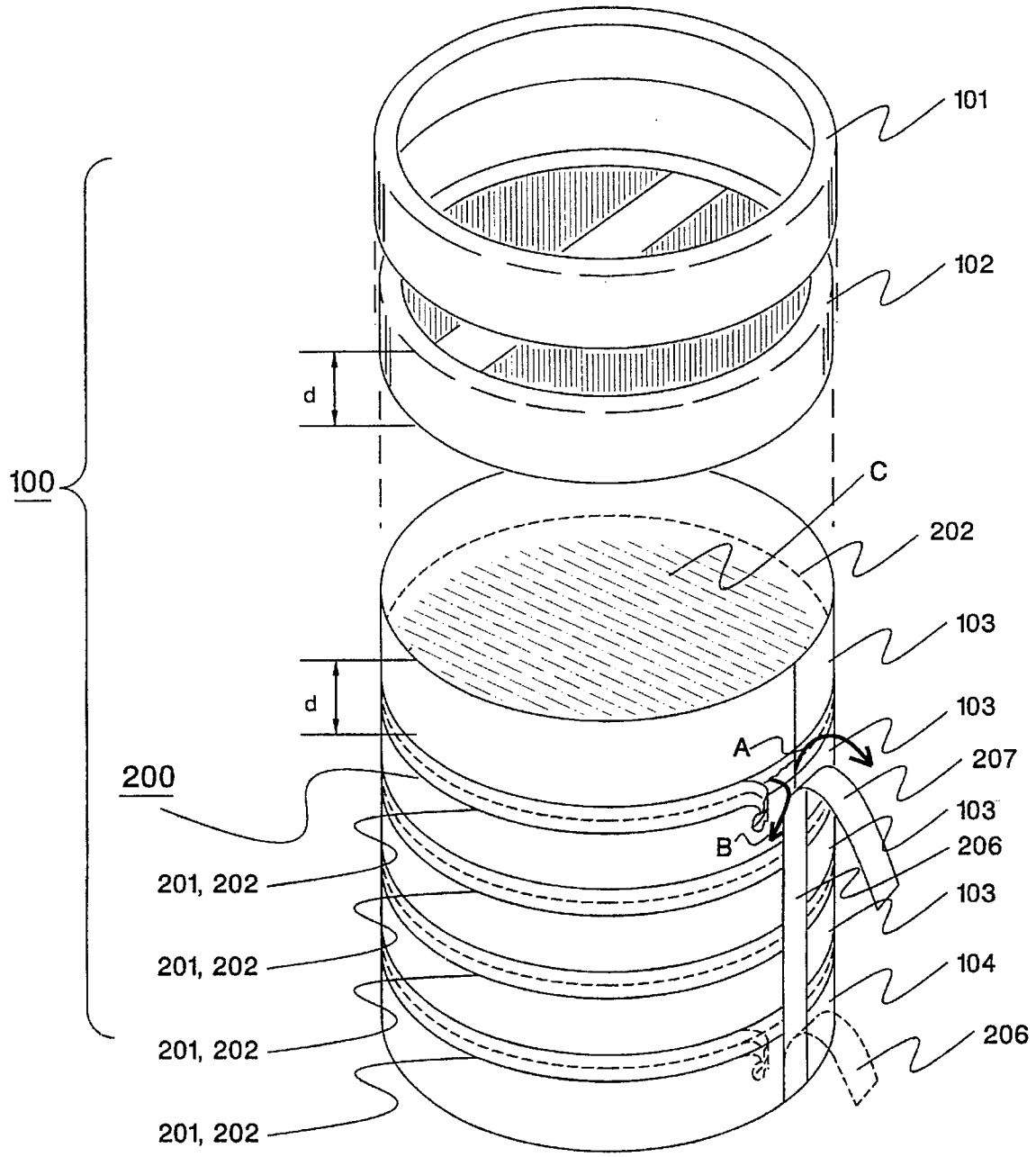
FIG. 1 is a perspective view of a container apparatus, in accordance with the present invention, shown as a cylindrical container structure comprising a main cylindrical body that includes a plurality of perforating elements that delineate a plurality of detachable and discardable cylindrical shell sections.
Figure 2:
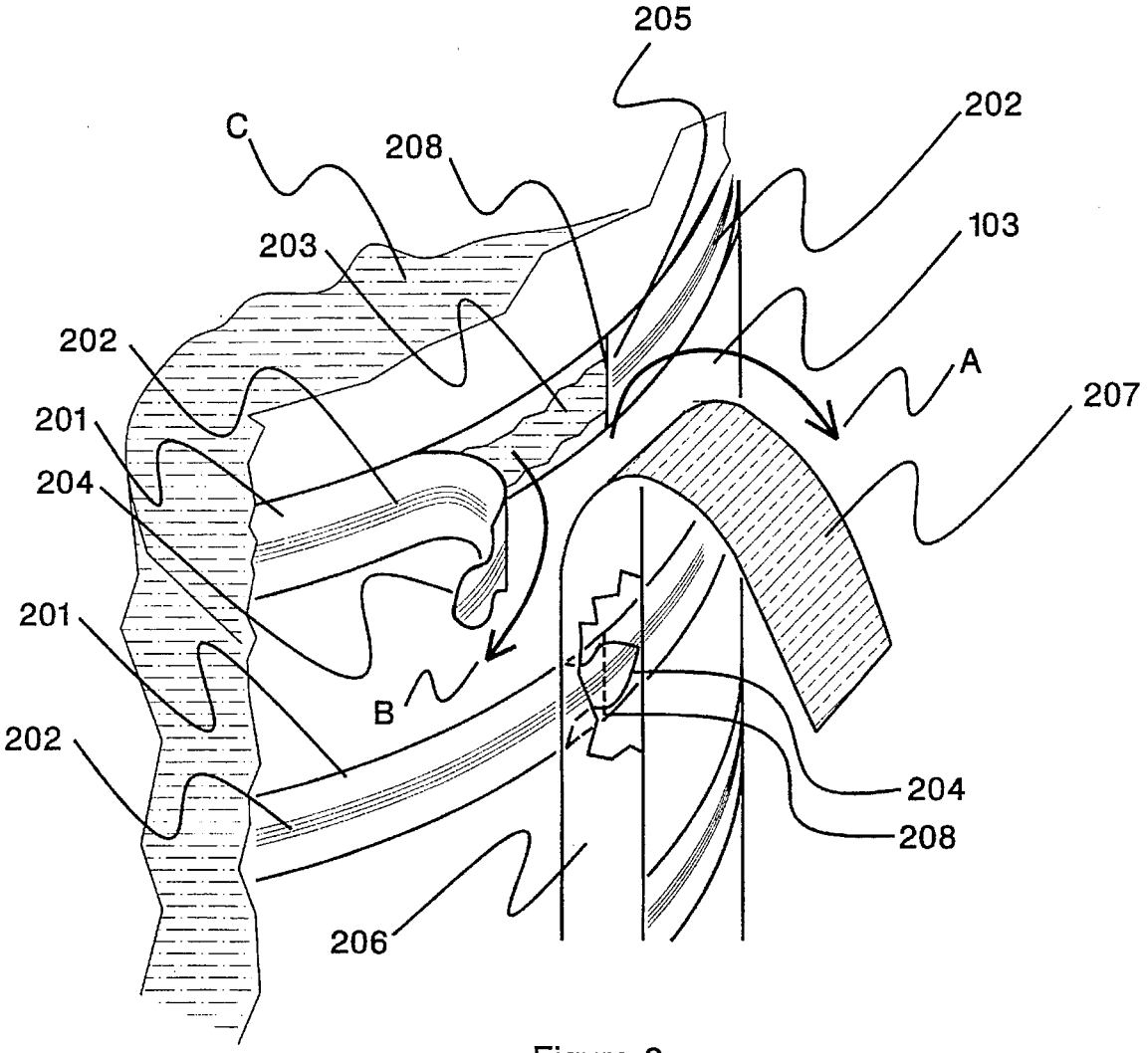
FIG. 2 is an enlarged view of a cylindrical shell section being detached from a cylindrical container as illustrated in FIG. 1, showing a tamper-proof seal being removed to expose a junctional region and a perforating element being pulled and causing perforation of an underlying wall section, in accordance with the present invention.

FIG. 1 shows a cylindrical container apparatus 100, in accordance with the present invention, and shown formed in a configuration typical of half gallon ice cream containers used in the industry. Container 100 is shown as comprising a lid seal member 101, a reusable lid member 102, a main cylindrical body, shown as comprising a plurality of detachable and discardable cylindrical shell sections 103, and a bottommost body portion 104. Shell sections 103 are delineated by a plurality of wall section detachment elements 201,202 spatially disposed on the wall of the main cylindrical body. Detachment elements 201, 202 are members of system 200 which facilitates formation of the plurality of discardable shell (or wall) sections 103. As best seen in FIG. 2, system 200 comprises strip member 201, a perforating member 202, a pull tab member 204, an end portion 205, a tamper-proof seal member 206.

Referring back to FIG. 1, perforating member 202 is embedded onto strip member 201 and is bonded to the underlying wall region of the main cylindrical body to delineate the plurality of shell sections 103. The bond of the perforating member 202 is shown internal to the container as broken lines. As depicted in FIG. 1, the shell sections 103 are shown spatially apart by at least a distance d that relates to the depth of lid member 102. The graduations for spacing sections 103 are predetermined by a container manufacture according to the volume of the container, the stored contents C, and rate of consumption of the contents C in the container after being opened- For a half-gallon container for storing ice cream, graduations of at least one and a half (1½) inches are believed appropriated.

Figure 3:
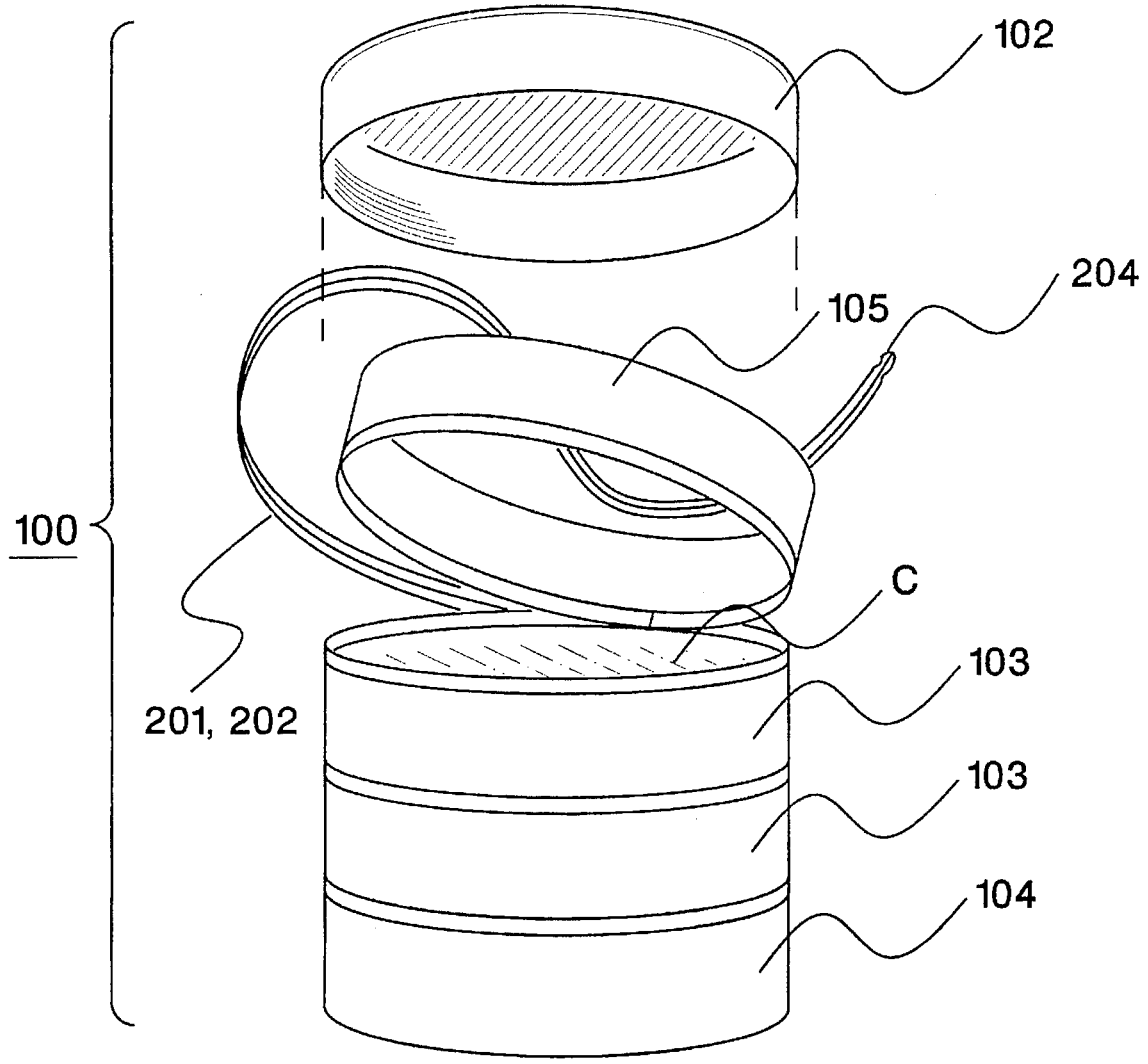
FIG. 3 shows a cylindrical container as shown in FIG. 1 further illustrating a cylindrical shell section in a final stage of being detached and prior to being discarded, and further illustrating a lid member in a ready state for covering a newly determined uppermost wall section that is in close proximity to the contents, in accordance with the present invention.

As shown in FIG. 1, and best illustrated in FIG. 2, the selective re-sizing of container 100 preferably begins by removing a tamper-proof seal 206, as shown by motion arrow A, followed by pulling on tab end 204, as shown by motion arrow B. As shown, tamper-proof seal 206 is an elongated strip having an adhesive coating 207 that attaches to the outer wall of the main cylindrical body. Other configurations of tamper-proof seal 206 are possible, the object being to cover a junctional region 208 defined by the junction of pull tab 204 and end portion 205. The pulling action depicted by arrow B results in perforating the underlying wall of the cylindrical body to form an opening 203. FIG. 3 shows a detached strip member 201 with embedded perforating member 202 and a detached cylindrical shell section, depicted with numeral 105, in a final stage of being detached prior to being discarded. Lid member 102 is shown in a ready state for covering a next determined uppermost wall section 103 that is in close proximity to the contents C.

Figure 4:
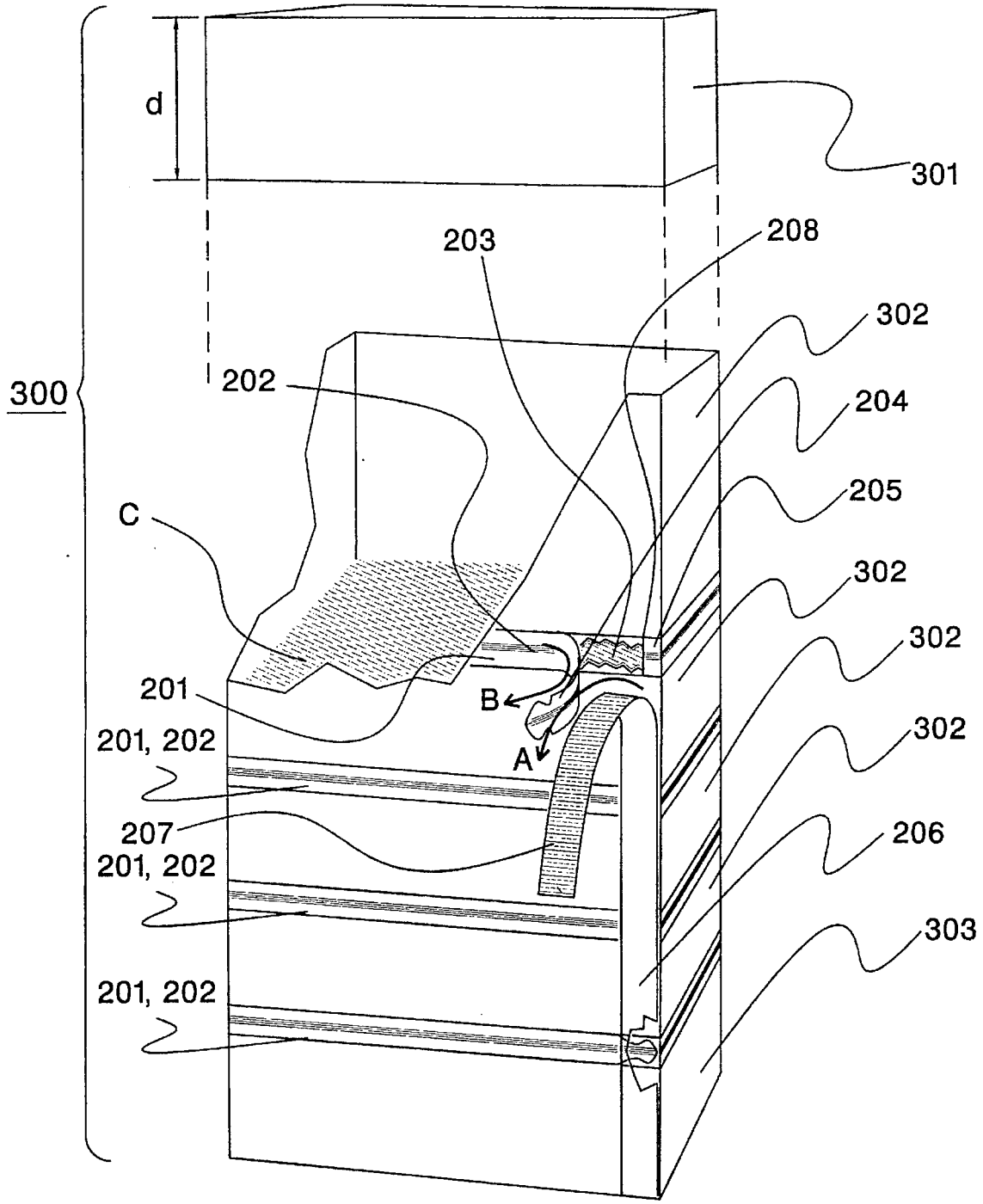
FIG. 4 is a perspective view of a container apparatus, shown as an elongated rectangular container structure comprising a body that defines a volume and a lid system for enclosing the body, the body includes a plurality of perforating elements that delineate a plurality of detachable and discardable rectangular shell sections, in accordance with the present invention.

FIG. 4 shows an alternative container apparatus 300, shown as an elongated rectangular container structure, typical for storing dried food product. Detaching system 200 is compatible for being utilized with this rectangular container configuration, as well as other geometrical configuration that a container manufacture may wish to produce. Except for dimensional differences, the members of system 200 used for container apparatus 300 are substantially the same as used for container apparatus 100. As depicted in FIG. 4 SYSTEM 200 comprises strip member 201, a perforating member 202, a pull tab member 204, an end portion 205, a tamper-proof seal member 206. Here, container 300 is shown as comprising a reusable lid member 301, a main rectangular body, shown as comprising a plurality of detachable and discardable rectangular shell sections 302, and a bottommost rectangular body portion 303. As in the cylindrical container embodiment, shell sections 302 are delineated by a plurality of wall section detachment elements 201, 202 spatially disposed on the wall of the main rectangular body. The selective re-sizing of container 300 preferably begins by removing a tamper-proof seal 206, as shown by motion arrow A, followed by pulling on tab end 204, as shown by motion arrow B. The perforated top shell is detached and discarded in a manner similar to that depicted for the cylindrical container embodiment shown in FIG. 3.

In either embodiments 100, 300, the container size is reduced and the air space immediately above the remaining content C in an opened container is correspondingly reduced. The resulting reduction in air space is believed to significantly improve the freshness in products such as ice cream, as well as conserve on the space for storing the container. The invention is particularly suited for containers manufactured from cardboard, or other fibrous material that can be perforated by a perforating member 202. Perforating member 202 is preferably a nylon filament structure that is saturated with an adhesive that facilitates perforation of the underlying region of the main container body and which adheres to, and remains with the strip member 201.

Therefore, while the present invention has been shown and described herein in what is believed to be the most practical and preferred embodiments, it is recognized that departures can be made therefrom within the scope of the invention, which is therefore not to be limited to the details disclosed herein but is to be accorded the full scope of the claims so as to embrace any and all equivalent apparatus.

I claim:

1. A geometrically designed container apparatus, said apparatus comprising:

(a) a body defining a volume, said body comprising:

(i) a main wall section, (ii) a plurality of wall section detachment elements spatially disposed on said main wall section, said detachment elements delineating a plurality of detachable and discardable wall sections, each of said wall section detachment elements comprise a strip member, each strip member includes a perforating element in contact with art underlying region of said main wall section, each perforating element being selectively utilized to cause said underlying region to be perforated for forming a detachable wall section, each strip member having a pull tab portion and an end portion, in an un-utilized state, said pull tab portion and said end portion being disposed on said body in an overlapping configuration and forming a junctional region, and (iii) a tamper-proof seal covering said junctional region; and (b) a lid for enclosing said body.

2. A container apparatus as described in claim 1, wherein:

said geometrically designed container apparatus comprises a cylindrical structure.

3. A container apparatus as described in claim 1, wherein:

said geometrically designed container apparatus comprises a rectangular structure.

* * * * *